US005706872A

United States Patent [19]

Schlesinger

[11] Patent Number: 5,706,872

[45] Date of Patent: Jan. 13, 1998

[54] COLLAPSIBLE CONTAINER FOR BULK TRANSPORT AND HANDLING OF HEAT MELTABLE MATERIALS

[76] Inventor: Sol Schlesinger, 55 Haul Rd., Wayne, N.J. 07470

[21] Appl. No.: 618,200

[22] Filed: Mar. 19, 1996

[51] Int. Cl.[6] ..... B65B 1/04

[52] U.S. Cl. ..... 141/82; 141/2; 141/18; 141/114; 222/146.5; 220/666; 219/385; 219/441; 53/457; 53/564

[58] Field of Search ..... 141/82, 114, 231, 141/18, 2; 220/666, 907; 206/447; 222/146.5, 206, 215; 219/385, 386, 438, 441, 442, 443, 444, 447, 448; 53/457, 459, 564, 127, 440

[56] References Cited

U.S. PATENT DOCUMENTS

| | | | |
|---|---|---|---|
| 2,136,738 | 11/1938 | Giordano . | |
| 2,260,395 | 10/1941 | Mudge . | |
| 3,240,394 | 3/1966 | Modderno . | |
| 3,590,888 | 7/1971 | Coleman . | |
| 3,831,815 | 8/1974 | Glasgow | 222/146.5 |
| 4,048,994 | 9/1977 | Lo . | |
| 4,050,740 | 9/1977 | Ellithorpe et al. . | |
| 4,082,109 | 4/1978 | Sun et al. . | |
| 4,461,599 | 6/1984 | Tanaka | 405/210 |
| 4,515,189 | 5/1985 | Mowatt-Larssen . | |
| 4,597,609 | 7/1986 | Deszynski et al. . | |
| 4,622,085 | 11/1986 | Yamada et al. | 141/114 |
| 4,661,688 | 4/1987 | Gabryszewski . | |
| 4,924,897 | 5/1990 | Brown . | |
| 5,100,026 | 3/1992 | Farrell . | |
| 5,115,944 | 5/1992 | Nikolich . | |
| 5,137,179 | 8/1992 | Stoffel . | |
| 5,312,018 | 5/1994 | Evezich . | |
| 5,318,198 | 6/1994 | Micek et al. | 222/146.5 |
| 5,339,989 | 8/1994 | Coleman . | |
| 5,518,046 | 5/1996 | Furukawa et al. | 141/114 |

*Primary Examiner*—David J. Walczak
*Assistant Examiner*—Steven O. Douglas
*Attorney, Agent, or Firm*—Greenblum & Bernstein, P.L.C.

[57] ABSTRACT

A collapsible container for facilitating the transportation and handling of heat meltable materials, such as, e.g., caprolactam, hexamethylene diamine (HMDA), dodecanedioic acid (DDDA), or any monomer and salt combinations used in the production and polymerization of polyamides. An expandable/collapsible container or bag is employed for holding and dispensing the bulk material. The bulk material is transported in a solid form, and converted to liquid form for removal from the container. The container includes heat tubing circulating a heat carrying medium or a heating element for heating and converting the bulk material to liquid form. The liquified material is then pumped from the container into a suitable storage facility.

23 Claims, 2 Drawing Sheets

COLLAPSIBLE CONTAINER FOR BULK TRANSPORT AND HANDLING OF HEAT MELTABLE MATERIALS

BACKGROUND OF THE INVENTION

1. Field of the Invention

The present invention is directed to facilitating the transportation and handling of heat meltable materials such as, e.g., caprolactam, hexamethylene diamine (HMDA), dodecanedioicacid (DDDA), sulfur, asphalt, bituminous material, polymers and any monomers or salts of monomers used in the production and polymerization of polyamides. An expandable/collapsible container or bag is employed for holding and dispensing the bulk material.

2. Discussion of the Background Information

It is well known that it is advantageous, when loading, transporting, and discharging certain heat meltable materials, e.g., sulfur, asphalt, bituminous material, polymers, etc. , to convert the solid material to liquid form. Various methods, for example, described in U.S. Pat. No. 4,050,740 by ELLITHORPE et al., U.S. Pat. No. 4,597,609 by DESZYNSKI et al., U.S. Pat. No. 4,515,189 by MOWATTLARSSEN, and U.S. Pat. No. 4,924,897 by BROWN disclose that certain solids, e.g., sulfur, are advantageously converted to a liquid state prior to transporting and prior to discharging.

Other materials may also be converted to a liquid state to enable withdrawal from the transport vessel. For example, U.S. Pat. No. 2,136,738 by GIORDANO discloses a tank car for transporting, for example, asphalt, bituminous material, etc., in which the transported product is heated and liquefied for proper discharge.

A system for transferring heat from or to a viscous fluid, e.g., a polymer, to thereby solidify or liquify the same was disclosed by SUN et al. in U.S. Pat. No. 4,082,109.

It is known to employ pressurized containers for keeping and/or dispensing certain materials, e.g., freon, carbondioxide, blood, grease, etc., so as to store the material in a contamination-free environment.

Various methods, for example, described in U.S. Pat. No. 3,240,394 by MODDERNO, U.S. Pat. Nos. 3,590,888 and 5,339,989 by COLEMAN, U.S. Pat. No. 5,115,944 by NIKOLICH, and U.S. Pat. No. 5,137,179 by STOFFEL disclose that it is advantageous to store certain gaseous or fluid materials in a pressurized flexible container of, e.g., polyolefin/polyester, polyethylene, polypropylene, or polyvinylchloride. However, each of these systems requires an outer pressurized chamber to be evacuated as the flexible container is filled.

U.S. Pat. No. 4,048,994 by LO and U.S. Pat. No. 5,312,018 by EVERICH disclose flexible/collapsible containers for dispensing medical fluids, e.g.,blood, intravenous fluid, etc. These devices require an outer chamber to become increasingly pressurized to dispense the stored fluids.

In an alternative system, for example, U.S. Pat. No. 5,100,026 by FARRELL discloses a collapsible container for storing and transporting fluid materials, such as liquids, powders, and granular material. The fluid material is introduced through a hole in the top of the container and discharged through a hose connected to the bottom of the container.

SUMMARY OF THE INVENTION

It is an object of the present invention to provide a convenient and inexpensive apparatus and method for preferably storing and transporting relatively low melting solids, e.g., caprolactam, HMDA, DDDA, sulfur, asphalt, bituminous material, polymers, or any monomers or salts of monomers used in the production and polymerization of polyamides.

Accordingly to the present invention, a flexible protective liner is disposed within the container for increasing physical strength and is sealed to maintain the material in an isolated and uncontaminated environment.

Thus, one aspect of present invention is directed to a collapsible container for transporting and handling a heat meltable material that includes a plurality of layers including at least a first and second layer, the first layer being resistant to the material, a pair of end members, including a first end member and a second end member, the pair of end members mounted for relative movement, and a heat producing member for converting the material into a liquid form, the heat producing member expanding and compressing with the relative movement of the pair of end members.

According to another aspect of the present invention, the container also includes an inlet port for receiving a heat producing supply and an outlet port for the heat producing supply after the heat producing supply has circulated through the heat producing member.

According to a further aspect of the present invention, the heat producing supply includes one of water, steam, and a heat transfer medium. The heat transfer medium including one of silicone fluid and mineral oil.

According to yet another aspect of the present invention, heat producing supply includes an electrical source.

According to another aspect of the present invention, the heat producing member includes a heating tube comprising at least one member selected from the group consisting of polyethylene, polypropylene, and aluminum foil.

According to another aspect of the present invention, the heat producing member includes a resistance wire element coated with at least one member selected from the group of silicone, polytetrafluoroethylene, polyphenylene sulfide, and thermoplastic.

According to a further aspect of the present invention, the heat producing member has two ends and is arranged in the form of a helical coil, such that the two ends are coupled to the inlet and the outlet. The two ends are coupled to the first end member and an apex of the helical coil is coupled to the second end member.

According to yet another aspect of the present invention, the first layer includes at least one of polyethylene, polypropylene, and aluminum foil. According to yet another aspect of the present invention, the second layer includes one of paper, cloth, polymeric material, and metallic material. The polymeric material can include at least one of the members of the group consisting of woven polyethylene, non-woven polyethylene, high density polypropylene, olefinic material, ionomeric material, and thermoplastic material.

According to a further aspect of the present invention, the heat meltable material includes at least one of caprolactam, HMDA, DDDA, and any monomers or salts of monomers used in the production and polymerization of polyamides.

Another aspect of the present invention is directed to a method of preparing and filling a collapsible container for transporting and handling a heat meltable product. The method includes the steps of evacuating any entrapped air within the collapsible container, compressing the collapsible container into a compressed position, purging an interior of the collapsible container to ensure the interior is contaminant free, coupling a sealing member to a material outlet port of the collapsible container, coupling one of a sealing member or a material supply to an inlet to a material inlet port of the collapsible container, that material supply comprising the heat meltable product in liquid form, storing the collapsible container if the sealing member is coupled to the material inlet port, filling the collapsible container with the heat meltable product if the material supply is coupled to the material inlet port of the collapsible container, removing the material supply from the material inlet port when the collapsible container is in an expanded position, and coupling the sealing member to the inlet port of the collapsible container for at least one of storing and transporting the container, wherein the heat meltable product solidifies in the collapsible container.

According to another aspect of the present invention, the collapsible container is purged with an inert gas.

A further aspect of the present invention is directed to a method for removing a heat meltable product from a collapsible container. The method includes the steps of coupling a heat producing supply to an inlet port of the collapsible container, coupling an output port of the collapsible container to the heat producing supply, liquefying the heat meltable product within the collapsible container by circulating the heat producing through a heat producing member, removing the heat producing supply from the collapsible container after the heat meltable product is liquified, removing a sealing member from a material outlet port of the collapsible container, coupling an evacuating means for removing the liquified heat meltable product from the collapsible container, evacuating the contents of the collapsible container to place the collapsible container in a compressed position, removing the evacuating means from the material outlet port, and replacing the sealing member on the material outlet port.

BRIEF DESCRIPTION OF THE DRAWINGS

The present invention is further described in the detailed description which follows, in reference to the noted drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 3:
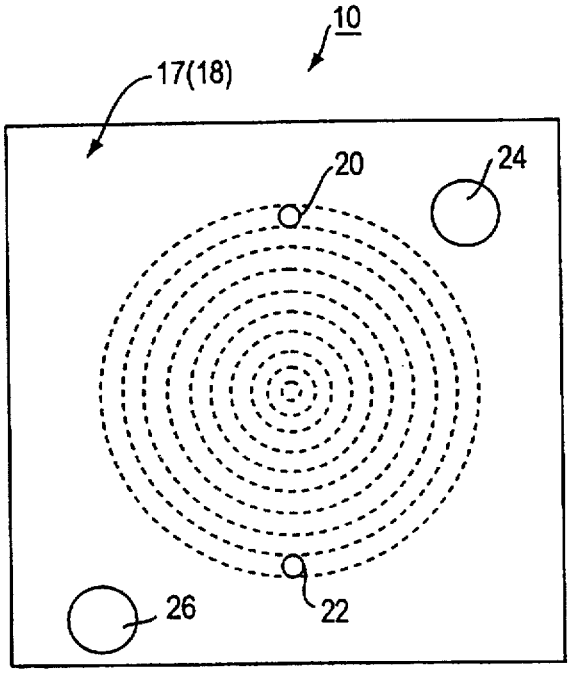
FIG. 3 shows a front view of the container according to the present invention.

The preferred embodiment of the present invention will now be described with reference to FIGS. 1–3. According the present invention, the collapsible container 10 comprises an internal layer 12, an external layer 14, a heating tube 15, and rigid end members 17, 18.

Internal layer 12 is designed to be resistant to the material to be contained therein. By resistant, the present invention contemplates that, because the material is to be loaded into and to be removed from the container as a liquid, internal layer 12 must be inert to the molten material to be contained therein. For example, because the present invention preferably is utilized with caprolactam, HMDA, DDDA, any monomers or salt combinations thereof used in the production or polymerization of polyamides (polyester), the internal layer is preferably resistant to these materials. Thermoplastics (monoaxial or biaxial), e.g., polyethylene, polypropylene, and metallic foil layers, e.g., aluminum foil, have been shown to resist the materials to be preferably contained and therefore are preferred materials for internal layer 12. Internal layer 12 is preferably designed to a thickness of approximately 0.5–25.0 mils. When a biaxial material, e.g., a polypropylene material that is prepared by two-dimensional stretching, is employed for the internal layer, the thickness may be between 0.5 mils and 5 mils, and preferably approximately 1.0 mils thick; when a monoaxial material, e.g., a polypropylene material that is prepared by one-dimensional stretching, is employed for the internal layer, the thickness may be between 1.0 mils and 25.0 mils, and preferably approximately 3.0 mils thick.

External layer 14 is designed to be flexible, yet strong enough to contain, protect, and retain inner layer 12. External layer 14 preferably is comprised of woven or nonwoven polyethylene, high density polyethylene, paper, cloth, or other suitable material, and may be made of polymeric materials, e.g., thermoplastic, ionomeric, olefinic material or metallic materials. In the preferred embodiment, the external layer is preferably designed to a thickness of approximately the same as the internal layer, i.e., 0.5–25.0 mils.

Figure 1:
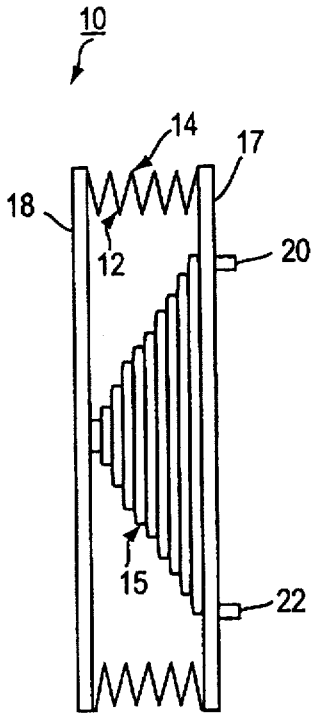
FIG. 1 shows a sectional side view of a flexible container and flexible tubing in its compressed stage according to the present invention taken along line A—A in FIG. 3.
Figure 2:
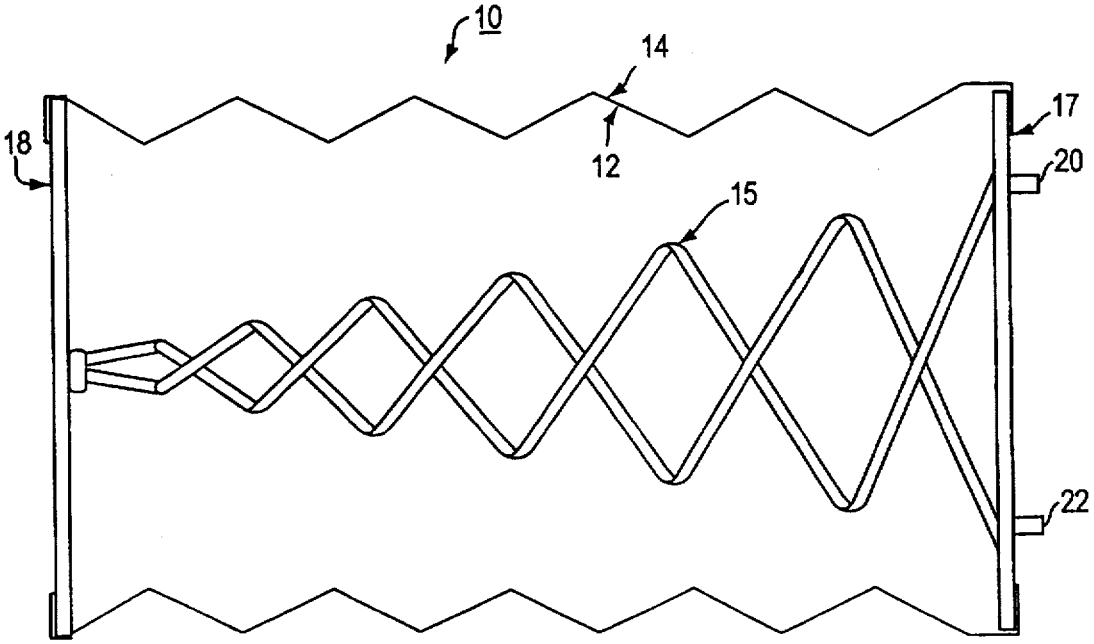
FIG. 2 shows a sectional side view of the flexible container and flexible tubing in its expanded stage of the present invention taken along line A—A in FIG. 3.

As shown in FIGS. 1 and 2, the internal and external layers 12, 14 are movable together from a compressed position (FIG. 1) to an expanded position (FIG. 2), and vice versa. The internal and external layers may be attached, e.g., fused together, or separate. The flexible container has a cross-sectional configuration that may be, for example, circular, square, polygonal, etc., with any dimensions that may be desired by the ordinarily skilled artisan. However, due to capacity of normal shipping containers, a preferred dimension for the cross-section of collapsible container may be approximately 8'×8'. In the compressed position, the flexible container of the present invention may preferably approximately 2"–12" in length. In the expanded position, the flexible container may preferably approximately 20'–40' in length.

Heat tubing 15 is preferably oriented in a conical spiral configuration in which the base is preferably mounted to the inside of rigid end member 17 and the apex is preferably mounted to the inside of rigid end member 18. Heating tube 15 also includes an inlet 20 and an outlet 22, which penetrate rigid end member 17 for receiving and expelling, respectively a heat carrying medium. Heat tubing 15 may preferably be made of, e.g., the same materials as internal layer 12, and the heat carrying medium may preferably be, for example, hot water, steam, or other heat transfer medium, e.g., silicone fluid or mineral oil.

Heat tubing 15 is preferably circular in cross-section, however, any other shape that allows circulation of the heat carrying medium is within the purview of the present invention. In general, heat tubing 15 is preferably disposed such that approximately 1–5 spirals are positioned per foot in length of the container (expanded). The specific temperature produced by the circulating heat carrying medium depends upon the material within the container. For example, if the material is caprolactam (which has a heat of fusion number of approximately 124 KJ/kg), the produced temperature must be at least 150° F., i.e., the melting point of caprolactam.

Rigid end member 17, in addition to the inlet 20 and outlet 22 of heat tubing 15, includes a material inlet 24 and a material outlet 26. Each of the inlet and outlet ports 20, 24 and 22, 26 may be provided with coupling members (not shown) for mechanically coupling the flexible container to the heat carrying medium and to a material supply (not shown). Rigid end members 17, 18 are preferably constructed of, e.g., the same material as the internal layer 12, carboard, or metal, and dimensioned to be approximately 1"–1.5" thick. Inlet 24 and outlet 26 are preferably approximately 1.5"–2" in diameter.

Given the preferred materials and dimensions of the preferred embodiment, an 8'×8'×20' container is preferably designed to hold approximately 40,000 pounds of material, e.g., caprolactam. However, the total weight of the material within the container depends upon the per unit mass of the material, whether the container is full, etc.

To use the flexible container of the present invention, the container may be compressed or evacuated so as to remove any entrapped air, e.g., placed into the compressed position as shown in FIG. 1. The container may then preferably be purged with a suitable inert gas, e.g., nitrogen, to ensure that the container is contaminant free prior to filling. Material inlet 24 and material outlet 26 are then sealed by suitable sealing members (not shown) and may be stored until it is desired to fill the flexible container.

To fill the flexible container with a material, e.g., caprolactam, a supply line, or other suitable material transfer means, may be coupled to material inlet 24, and the material is pumped into the container in either solid or liquid form, although the liquid form is preferred. As the material continues to be pumped into the container, the container begins to fill and expand until it reaches the expanded (or filled) position shown in FIG. 2. Once filled, the supply line is removed from material inlet 24, and material inlet 24 is sealed by the suitable sealing member.

Once the container is filled and sealed, the material inside the container freezes, i.e., solidifies. The container may then be stored or transported in any suitable manner to a desired destination.

When it is desired to remove the material from the container 10, a heat carrying medium supply source (not shown) is coupled to inlet 20 for supplying the heat carrying medium into the container via heat tubing 15. A heat carrying medium withdrawing device (not shown), e.g., a pump, may be coupled to outlet 22 for drawing out the heat carrying medium supplied to heat tubing 15 through inlet 20. Alternatively, a heat carrying medium receiver or reservoir (not shown), e.g., a supply tank, may be coupled to outlet 22 to receive the heat carrying medium that has been circulated throught heat tubing 15. Thus, the heat carrying medium is caused to steadily flow through heat tubing 15. As the heat carrying medium circulates through heat tubing 15, the material within the container is thereby heated and converted into liquid form.

Once the product is in liquid form, a discharge hose (not shown) is coupled to material outlet 26. The discharge hose may preferably be coupled to a pump (not shown) or other suitable means for forcibly extracting the material from container 10 and introducing the material into a suitable storage facility (not shown). Because the container is preferably evacuated of entrapped air, as the material is pumped from the container, rigid end member 18 will be forced toward rigid end member 17 until the container is empty and in the compressed position. At this point, the discharge hose may be removed from the container and the suitable sealing member may be replaced over material outlet 26. Thus, the container is ready for reuse to transport the same material. Further, if the internal layer, external layer, and heating tube are made of the same material, the collapsible container of the present invention is fully recyclable.

Figure 4:
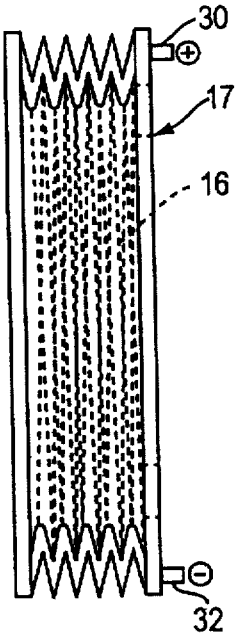
FIG. 4 shows a sectional side view of a flexible container and heating elements in its compressed stage according an alternative embodiment of the present invention taken along line B—B in FIG. 6.
Figure 6:
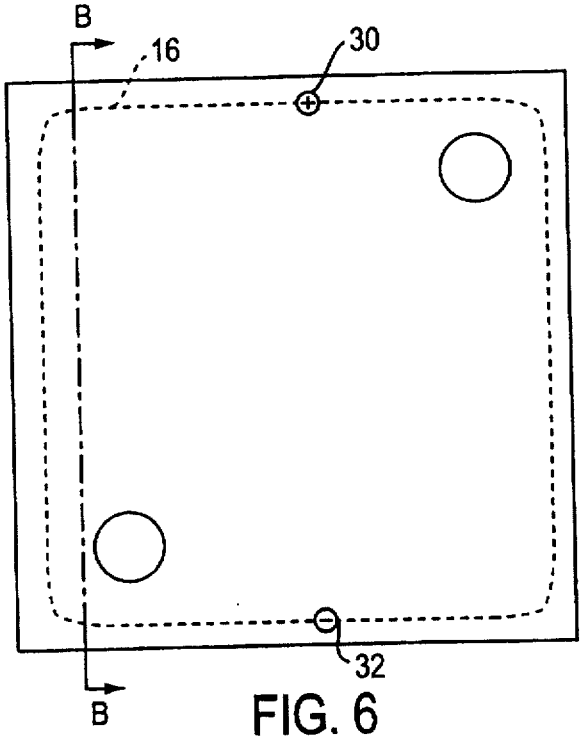
FIG. 6 shows a front view of the container according to the alternative embodiment of the present invention.
Figure 5:
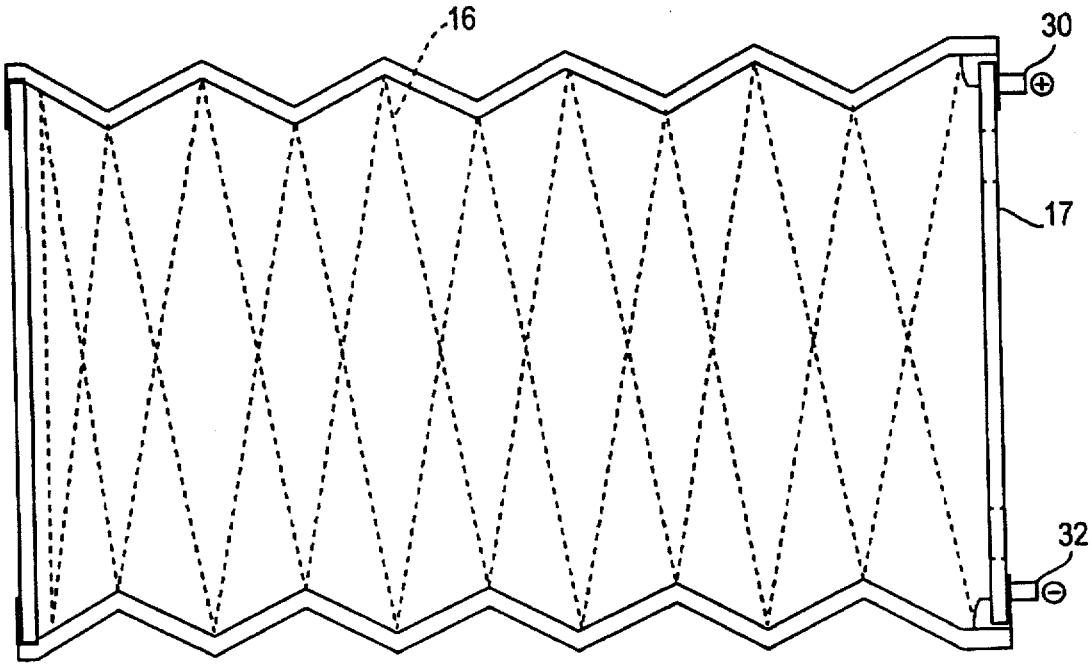
FIG. 5 shows a sectional side view of the flexible container and heating elements in its expanded stage according to the alternative embodiment of the present invention taken along line B—B in FIG. 6.

An alternative embodiment of the present invention will now be described with reference to FIGS. 4–6. The alternative embodiment is substantially similar to the preferred embodiment except that heating tube 15 has been replaced with a heating element 16, and rigid end member 17 includes electrical contacts 30, 32.

Heating element 16 may be a metallic resistance wire element coated with, e.g., silicone, polytetrafluoroethylene (Teflon), polyphenylene sulfide, or thermoplastic. While heating element 16 is preferably arranged as a conical helicoid, i.e., arranged within the container just as the heating tube 15 in FIGS. 1–3, the heating element may be alternatively arranged as shown in FIGS. 4–6 as helically traversing the length of container 10 along its inner periphery. It is noted, however, that still other arrangements of heating element 16 may be contemplated by those ordinarily skilled in the art.

Rigid end member 17 is shown with a positive and negative node 30 and 32. Positive node 30 is coupled to one end of heating element 16 and negative node 32 is coupled to the other end of heating element 16. It is noted that the source for heating element 16 in the alternative embodiment may be either d.c. or a.c. current.

The operation of filling container 10 is the same in the alternative embodiment as in the preferred embodiment, however, the material removal is somewhat different. At the desired material removal location, a d.c. electric source (not shown) is connected to heating element 16 through the positive and negative nodes 30, 32. As the d.c. current flows, heating element 16 will begin to heat the container and its contents. Thus, the material will be liquified as the heat increases. The discharge hose (not shown) will then be connected to the container as described in the preferred embodiment.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A collapsible container for transporting and handling a heat meltable material comprising:

a flexible layer for holding the material, said flexible layer being inert with respect to the material and movable between a first and second position; and a heat producing member for converting the material into a liquid form, said heat producing member expanding and compressing between said first and secbnd position.

2. The collapsible container according to claim 1, said container further comprising:

an inlet port for receiving a heat producing supply; and an outlet port for said heat producing supply after said heat producing supply has circulated through said heat producing member.

3. The collapsible container according to claim 2, said heat producing supply comprising one of water, steam, and a heat transfer medium.

4. The collapsible container according to claim 3, said heat transfer medium comprising one of silicone fluid and mineral oil.

5. The collapsible container according to claim 2, said heat producing supply comprising an electrical source.

6. The collapsible container according to claim 2, said heat producing member having two ends and arranged in the form of a helical cone, such that said two ends are coupled to said inlet and said outlet.

7. The collapsible container according to claim 6, said container further comprising a pair of end members, comprising a first and second end member, said pair of end members mounted for relative movement with said heat producing member.

8. The collapsible container according to claim 7, said two ends being coupled to said first end member and an apex of said helical cone being coupled to said second end member.

9. The collapsible container according to claim 1, said heat producing member comprising a heating tube comprising at least one member selected from the group consisting of polyethylene, polypropylene, and aluminum foil.

10. The collapsible container according to claim 1, said heat producing member comprising an resistance wire element coated with at least one member selected from the group consisting of silicone, polytetrafluoroethylene, polyphenylene sulfide, and thermoplastic.

11. The collapsible container according to claim 1, said flexible layer including a first layer comprising at least one member selected from the group consisting of polyethylene, polypropylene, and aluminum foil.

12. The collapsible container according to claim 11, said flexible layer including a second layer comprising at least one member selected from the group consisting of paper, cloth, polymeric material, and metallic material.

13. The collapsible container according to claim 12, said polymeric material comprises at least one member selected from the group consisting of woven polyethylene, non-woven polyethylene, and high density polyethylene.

14. The collapsible container according to claim 1, the heat meltable material comprising at least one member selected from the group consisting of caprolactam, hexamethylene diamine, dodecanedioic acid, and any monomers or salts of monomers used in the production and polymerization of polyamides.

15. A method of preparing and filling a collapsible container for transporting and handling a heat meltable material, said method comprising:

coupling a material supply to a material inlet port of the collapsible container, the material supply comprising the heat meltable material in liquid form;

varying the collapsible container from a compressed position to an expanded position by introducing the material into the collapsible container;

removing the material supply from the material inlet port when the collapsible container is in the expanded position; and coupling a sealing member to the inlet port of the collapsible container for at least one of storing and transporting the container, wherein the heat meltable material solidifies in the collapsible container.

16. The method for filling a collapsible container, according to claim 15, wherein the collapsible container is purged with an inert gas before coupling the material supply to the material inlet port.

17. The method for filling a collapsible container, according to claim 15, said heat meltable material comprising at least one member selected from the group consisting of caprolactam, hexamethylene diamine, dodecanedioic acid, and any monomers or salts of monomers used in the production and polymerization of polyamides.

18. The method for filling a collapsible container, according to claim 15, said method comprising the following before coupling the material supply to the material inlet port:

evacuating any entrapped air within the collapsible container;

compressing the collapsible container into a compressed position; and purging an interior of the collapsible container to ensure the interior is contaminant free.

19. A method for removing a heat meltable material from a collapsible container, said method comprising:

coupling a heat producing supply to an inlet port of the collapsible container;

coupling an output port of the collapsible container to the heat producing supply;

liquefying the heat meltable material within the collapsible container by circulating the heat producing supply through a heat producing member;

removing the heat producing supply from the collapsible container after the heat meltable material is liquified;

coupling a material removing means for removing the liquified heat meltable material from the collapsible container; and removing the contents of the collapsible container to place the collapsible container in a compressed position.

20. The method for removing the heat meltable material from the collapsible container according to claim 19, the heat meltable material comprising at least one member selected from the group of caprolactam, hexamethylene diamine, dodecanedioic acid, and any monomers or salts of monomers used in the production and polymerization of polyamides.

21. The method for removing the heat meltable material from the collapsible container according to claim 19, the heat producing supply comprising one of water and steam.

22. The method for removing the heat meltable material from the collapsible container according to claim 19, the heat producing supply comprising one of silicone fluid and mineral oil.

23. The method for removing the heat meltable material from the collapsible container according to claim 19, the heat producing supply comprising an alternate current (a.c.) or direct current (d.c.) electric source.

* * * * *